US007312687B2

(12) United States Patent
Ullermann

(10) Patent No.: US 7,312,687 B2
(45) Date of Patent: Dec. 25, 2007

(54) PROTECTIVE SWITCH FOR PROTECTING A CIRCUIT

(75) Inventor: Wolfgang Ullermann, Schwabach (DE)

(73) Assignee: Ellenberg & Poensgen GmbH, Altdorf (DE)

( * ) Notice: Subject to any disclaimer, the term of this patent is extended or adjusted under 35 U.S.C. 154(b) by 0 days.

(21) Appl. No.: 11/725,219

(22) Filed: Mar. 16, 2007

(65) Prior Publication Data

US 2007/0170047 A1 Jul. 26, 2007

Related U.S. Application Data

(63) Continuation of application No. PCT/EP2006/000933, filed on Feb. 3, 2006.

(30) Foreign Application Priority Data

Mar. 12, 2005 (DE) ..... 20 2005 004 002 U
Mar. 18, 2005 (DE) ..... 20 2005 004 409 U

(51) Int. Cl.
*H01H 37/70* (2006.01)
*H01H 37/52* (2006.01)

(52) U.S. Cl. ..... 337/66; 337/56; 337/72

(58) Field of Classification Search ..... 337/56, 337/72, 66; 200/339, 341
See application file for complete search history.

(56) References Cited

U.S. PATENT DOCUMENTS 2,467,653 A 4/1949 Berthier
3,932,829 A * 1/1976 Ellenberger ..... 337/49
4,258,349 A * 3/1981 Flory ..... 337/46
4,329,669 A * 5/1982 Krasser et al. ..... 335/20
4,338,586 A * 7/1982 Scanlon ..... 337/74
4,345,233 A * 8/1982 Matthies ..... 337/75
4,528,538 A * 7/1985 Andersen ..... 337/43
4,833,439 A * 5/1989 Bowden et al. ..... 337/68
4,922,219 A * 5/1990 Bakhaus et al. ..... 337/74
5,089,799 A * 2/1992 Sorenson ..... 337/68
5,223,813 A * 6/1993 Cambreleng et al. ..... 337/66
5,264,817 A * 11/1993 Sorenson ..... 337/68

(Continued)

FOREIGN PATENT DOCUMENTS

DE 842 082 6/1952

(Continued)

*Primary Examiner*—Anatoly Vortman
(74) *Attorney, Agent, or Firm*—Laurence A. Greenberg; Werner H. Stemer; Ralph E. Locher

(57) ABSTRACT

A protective switch for protecting a circuit includes an operating element or rocker switch, contact connections projecting from a housing, a contact spring electrically connected to a first contact connection and having a free end covering a second contact connection for making contact. A bimetallic element in the housing runs transversely to a slider longitudinal direction and is electrically connected between the first contact connection and through the contact spring to the second contact connection. A slider slides in the housing and has a contact end bearing against and acting upon the contact spring counter to its restoring force in a contact position. The slider is latched by the operating element in a turned-on position. The bimetallic element is coupled to the slider for thermal tripping and has a first longitudinal section at least partly covering and unlatching the slider upon overcurrent to break contact, and a second longitudinal section.

20 Claims, 6 Drawing Sheets

U.S. PATENT DOCUMENTS

| | | | | |
|---|---|---|---|---|
| 5,451,729 | A | 9/1995 | Onderka et al. | |
| 5,491,460 | A * | 2/1996 | Krasser et al. | 337/70 |
| 5,760,672 | A * | 6/1998 | Wang | 337/79 |
| 5,892,426 | A * | 4/1999 | Huang | 337/59 |
| 6,275,134 | B1 * | 8/2001 | Chen | 337/37 |
| 6,307,460 | B1 * | 10/2001 | Yu | 337/37 |
| 6,400,250 | B1 * | 6/2002 | Wang | 337/66 |
| 6,445,273 | B1 * | 9/2002 | Yu | 337/37 |
| 6,456,185 | B1 * | 9/2002 | Yu | 337/37 |
| 6,512,441 | B1 * | 1/2003 | Yu | 337/37 |
| 6,552,644 | B2 * | 4/2003 | Yu | 337/66 |
| 6,563,414 | B2 * | 5/2003 | Yu | 337/66 |
| 6,617,952 | B1 * | 9/2003 | Yu | 337/94 |
| 6,621,402 | B2 * | 9/2003 | Huang | 337/66 |
| 6,664,884 | B1 * | 12/2003 | Yu | 337/59 |
| 6,674,033 | B1 * | 1/2004 | Wang | 200/334 |
| 6,714,116 | B1 * | 3/2004 | Sang et al. | 337/68 |
| 6,734,779 | B2 * | 5/2004 | Yu | 337/59 |
| 6,788,186 | B1 * | 9/2004 | Yu | 337/66 |
| 2003/0160679 | A1 * | 8/2003 | Yu | 337/37 |

FOREIGN PATENT DOCUMENTS

| | | | |
|---|---|---|---|
| DE | 94 22 029 | U1 | 9/1997 |
| FR | 2605142 | A1 * | 4/1988 |

* cited by examiner

PROTECTIVE SWITCH FOR PROTECTING A CIRCUIT

CROSS-REFERENCE TO RELATED APPLICATIONS

This is a continuing application, under 35 U.S.C. §120, of copending International Application No. PCT/EP2006/000933, filed Feb. 3, 2006, which designated the United States; this application also claims the priority, under 35 U.S.C. §119, of German Patent Applications DE 20 2005 004 002.9, filed Mar. 12, 2005, and DE 20 2005 004 409.1, filed Mar. 18, 2005; the prior applications are herewith incorporated by reference in their entirety.

BACKGROUND OF THE INVENTION

Field of the Invention

The invention relates to a protective switch for protecting a circuit, including an operating element, contact connections projecting from a housing, and a contact spring electrically conductively connected to a first contact connection and having a free end covering a second contact connection in such a way that contact can be made.

Such a protective switch is known, for example, from German Utility Model DE 94 22 029 U1, corresponding to U.S. Pat. No. 5,451,729. A switch latch provided therein includes a trip lever which is coupled as an operating element to a rocker switch through a latching lever, for the purpose of manually switching on and off and for the purpose of independent tripping in an overcurrent situation. A heated bimetallic element acts on the trip lever in an overcurrent situation. A resultant motion of the trip lever causes the switch latch to be unlatched, with the consequence that the latching lever coupled to the trip lever breaks the contact.

SUMMARY OF THE INVENTION

It is accordingly an object of the invention to provide a protective switch for protecting a circuit, which overcomes the hereinafore-mentioned disadvantages of the heretofore-known devices of this general type and which has a particularly simple structure.

With the foregoing and other objects in view there is provided, in accordance with the invention, a protective switch for protecting a circuit. The protective switch comprises a housing, at least first and second contact connections projecting from the housing, an operating element, and a contact spring electrically conductively connected to the first contact connection and having a free end covering the second contact connection for making contact. The contact spring has a restoring force. A slider is guided for sliding in the housing. The slider has a contact end bearing against and acting upon the contact spring counter to the restoring force in a contact position. The slider has a longitudinal direction and is latched by the operating element in a turned-on position. A bimetallic element is disposed in the housing and extended transversely relative to the longitudinal direction of the slider. The bimetallic element is electrically connected between the first contact connection and through the contact spring to the second contact connection. The bimetallic element is coupled to the slider for thermal tripping and has first and second longitudinal sections. The first longitudinal section at least partly covers and unlatches the slider as a result of an overcurrent to break contact.

In accordance with another feature of the invention, the slider latches in the turned-on position of the protective switch, whereas there is no latching of the slider in the case of a protective switch in the form of a momentary-contact switch.

In accordance with a further feature of the invention, in order to move the slider into the turned-on position using the operating element, latch elements in the form of trip cams act together on the slider and on the operating element through a trip edge. The slider and therefore the operating element, which is expediently in the form of a rocker switch, latches in or locks in the manner of a latch or snap-fit connection. To this end, the operating element is provided with a first latch element and the slider is provided with a second latch element, and when the operating element is operated in the turned-on direction, the latch elements slide into the latch position through the trip edge, which is preferably provided on the operating element. Expediently, the trip edge is integrally formed on the operating element directly next to the detent. When the slider is moved into the ON position, the trip cam travels along the trip edge until the trip cam latches behind the detent. The latching of the trip cam locks the slider in the ON position.

In accordance with an added feature of the invention, in order to unlatch the latched slider as a result of thermal tripping, the slider is expediently disposed in the housing base so as to be able to rotate around an axis of rotation, preferably around the slider longitudinal axis, from a starting position. In this case, the operating element expediently carries a spring tongue which pivots when the operating element is operated and which returns the rotated slider to its starting position. The spring tongue provided for returning the slider which has been rotated from its starting position or its position of rest, may also be integrally formed on the inside of the housing.

In accordance with an additional feature of the invention, there are provided two contact springs, disposed above one another in the slider longitudinal direction, and two contact arms which are disposed, for example in steps and/or above one another, on the contact end of the slider in the slider longitudinal direction, each of which has its free end bearing against one of the contact springs.

In accordance with yet another feature of the invention, the slider is coupled to a bimetallic element for the purpose of thermal tripping of the protective switch. It is expediently electrically connected between the first contact connection and through the contact spring to the second contact connection. The bimetallic element has a first bimetallic element limb and a second bimetallic element limb, running at a distance from the latter, with the bimetallic element limbs merging at a bimetallic element end. An aligning unit disposed in the housing and having a bending point, allows manual alignment of the bimetallic element.

In accordance with yet a further feature of the invention, the bimetallic element is bent in a U shape to form a first, comparatively short bimetallic strip and a second, comparatively long bimetallic strip. The bimetallic element has its second, long bimetallic strip electrically conductively connected to the first contact connection, whereas the first, short bimetallic strip has its strip side which is remote from the long bimetallic strip bearing against the aligning element.

In accordance with yet an added feature of the invention, the first bimetallic element limb of the bimetallic element is electrically conductively connected to the first contact connection. The second bimetallic element limb of the bimetallic element is expediently electrically conductively connected to the contact spring through an intermediate piece which is held in the housing and which is preferably injection-molded into the housing base, which is made of plastic.

In accordance with yet an additional feature of the invention, the bimetallic element, which is preferably disposed in the housing or in the housing base so as to run transversely with respect to the slider longitudinal direction, has two longitudinal sections. Of these, a first longitudinal section at least partly covers the slider in such a way that the bimetallic element unlatches the slider as a result of an overcurrent in order to break contact. To this end, the slider expediently has the unlatching element integrally formed thereon in the form of a wing-like spring tongue which extends along the first longitudinal section of the bimetallic element. The spring tongue serves as an elongate rotary lever and, as a result of deflection of the bimetallic element, has the latter acting on it in order to rotate the slider. The latch mechanism formed by the detent and the trip cam is unlocked through rotation of the slider as a result of the overcurrent tripping. As a result, the slider which is in the ON position is moved into the OFF position by the contact spring parallel to the direction of spring force. This breaks the contact between the contact spring and the second contact connection.

In accordance with again another feature of the invention, the contact end of the slider is guided in a slider guide in the housing or in its housing base. In order to guide the slider in the housing, the slider guide has a slider stop. The slider guide is preferably a slot-like recess in a base wall of the housing base.

In accordance with again a further feature of the invention, the operating element can pivot between a turned-on position and a turned-off position and latches in a turned-on direction counter to a restoring force of a restoring spring. The housing has a housing base and a housing cap which can be fitted onto the latter. Integrally formed on the housing cap are two latch arms, expediently on opposite sides of the housing in the region of a leadthrough opening for the operating element, for mounting the housing in an installation opening.

In accordance with again an added feature of the invention, the operating element is provided with a restoring device for returning the operating element to a turned-off position. The restoring device, which returns the operating element to its turned-off position in the event of the overcurrent tripping, is preferably in the form of a helical spring. The operating element, which is expediently in the form of a rocker switch, can be manually moved either into the turned-on position or, in the manner of a manual release, into the turned-off position.

Overcurrent tripping of the protective switch can be recognized outside of the housing from the operating element which is in the turned-off position. The switch position of the operating element makes it particularly easy to tell whether the circuit protected by the protective switch is complete or interrupted.

In accordance with a concomitant feature of the invention, the protective switch is constructed to protect a plurality of circuits. To this end, the protective switch has contact connections projecting from the housing for each further circuit. Expediently, a respective contact spring is provided for each further circuit. The contact spring is electrically conductively connected, inside the housing, to the respective associated contact connection and is held by it. The second flat connector, associated with the same circuit, can make contact with the contact spring from above. In order to complete and break the circuit, the relevant contact or slider arm of the slider acts upon the respective contact spring counter to its direction of spring force. To this end, the slider is provided with contact arms disposed in the slider longitudinal direction in different planes, e.g. in steps or directly above one another, of which one respective contact arm bears against one of the contact springs disposed above one another in the slider longitudinal direction.

The advantages attained with the invention are, in particular, that the slider guided inside the housing can be used to perform a plurality of functions of a protective switch, which means that the latter may have a particularly simple construction. Thus, the latch element integrally formed on the slider in the form of a trip cam is used as a switch latch for locking the slider in the turned-on position (ON position) when the circuit is complete. The trip cam is also used to slide the slider from the turned-off position (OFF position) into the ON position.

The trip cam travels along the trip edge positioned directly next to the corresponding latch element of the operating element by operating the operating element in the turn-on direction. In addition, the slider can be slid manually into the ON or into the OFF position using the operating element. Furthermore, the slider serves as a contact switch for breaking and completing of the circuit. The additional rotary function of the slider is used to unlock a latch or snap-fit connection locking it in the ON position or a latch mechanism in the event of overcurrent tripping.

The use of the multifunctional slider means that the protective switch has a comparatively small number of individual components. This allows particularly simple production of the protective switch.

Other features which are considered as characteristic for the invention are set forth in the appended claims.

Although the invention is illustrated and described herein as embodied in a protective switch for protecting a circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
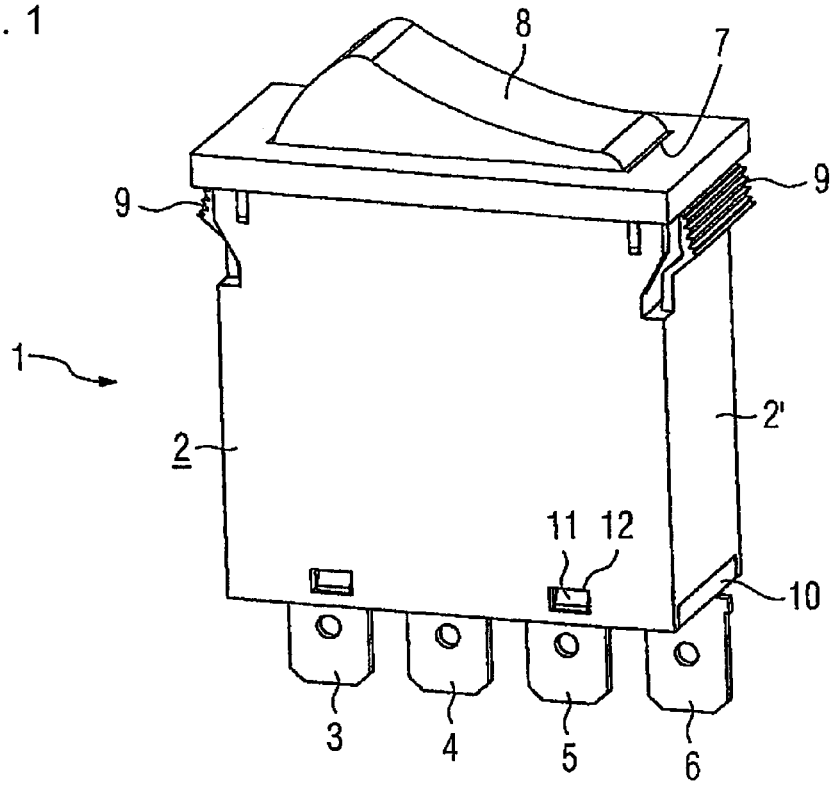
FIG. 1 is a diagrammatic, perspective view of a protective switch with contact connections projecting from a housing.

Referring now in detail to the figures of the drawings, in which mutually corresponding parts have been provided with the same reference symbols, and first, particularly, to FIG. 1 thereof, there is seen a perspective view of a protective switch 1 with a housing 2 from which contact connections 3 to 6 project at an underside or bottom. A housing cap 2' of the housing 2 has a housing opening 7 at the top in which an operating element 8 in the form of a rocker switch is mounted so as to be able to rotate or pivot. The operating element 8 allows the protective switch 1 to be manually turned on or manually turned off in the manner of a manual release.

Latch arms 9 provided on the housing 2 are used to latch and therefore to fix the protective switch 1 in an installation or mounting opening. The housing 2 is closed off by a housing base 10 on the underside of the housing. The housing base has latch elements 11 which latch into cutouts 12 provided in the housing cap 2' when the protective switch 1 is mounted.

Figure 2:
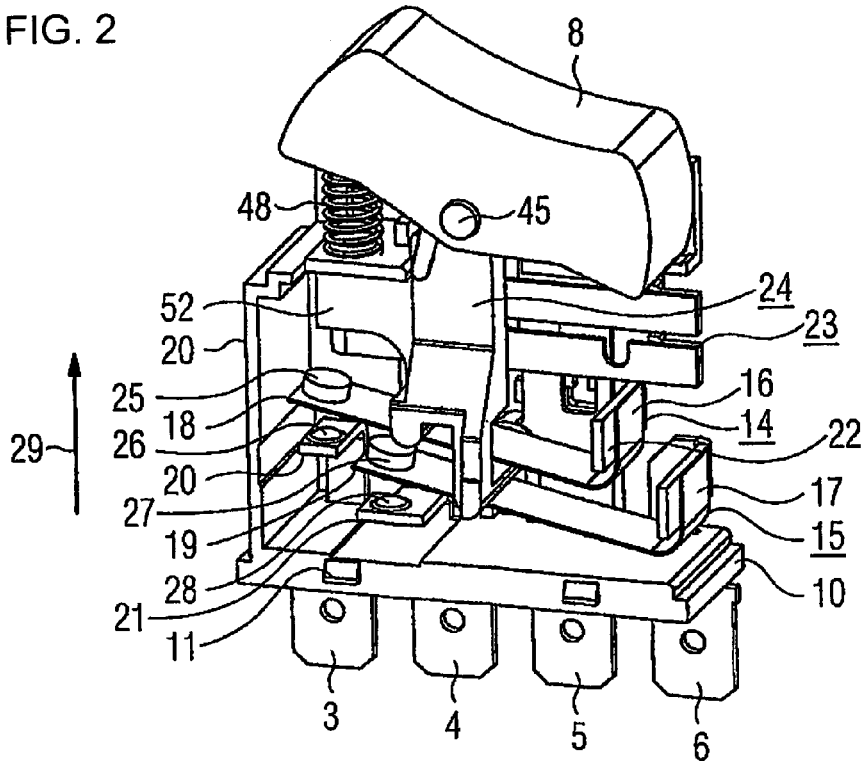
FIG. 2 is a perspective view of the interior of the housing of the protective switch shown in FIG. 1.

FIG. 2 shows a perspective view of the interior of the housing of the protective switch 1. All the individual components of the protective switch 1 are mounted on the housing base 10. The contact connections 3 to 6 project from the housing base 10 and therefore from the protective switch housing 2 on the underside of the housing.

The protective switch 1 is provided for the purpose of protecting two circuits. A first circuit has the associated contact connections 3 and 5 and a second circuit has the associated contact connections 4 and 6. The circuits can be completed and interrupted on the inside of the housing through the use of contact springs 14 and 15 associated with the respective contact connections 3 to 6. The contact springs 14 and 15 are held at fixed ends 16 and 17. Free ends 18, 19 which are opposite thereto cover free or contact ends 20, 21 of the contact connections 3 and 4 inside the housing. The fixed end 17 of the contact spring 15 is electrically conductively connected to and held on the contact connection 6. The fixed end 16 of the contact spring 14 is held by an intermediate piece 22 and is electrically conductively connected to the contact connection 5 through the use of the intermediate piece and through the use of a bimetallic element 23 coupled thereto.

The circuit which can be connected to the contact connections 3 and 5 is monitored for heat protection in such a way that a current flowing through the circuit and through the contact connection 5 into the protective switch 1 first of all flows through the bimetallic element 23, through the contact spring 14 and through the contact connection 3 out of the protective switch 1 again. In contrast, the circuit which can be connected to the contact connections 4 and 6 is not monitored for heat protection, since a current flowing through it flows through the contact connection 6 into the protective switch 1 and directly through the contact spring 15 and through the contact connection 4 out of this protective switch 1 again.

In order to complete and interrupt the respective circuit, a slider 24 is provided which is disposed in the housing base 10 so as to slide between a turned-on position (ON position) and a turned-off position (OFF position). In the view shown in FIG. 2, the slider 24 is in the OFF position. It is possible to tell this from opened contacts 25 to 28 between the free ends 18, 19 of the contact springs 14 and 15 and the free ends 20, 21 of the contact connections 3 and 4.

The slider 24 can firstly be slid manually either into the ON position or into the OFF position by operating the operating element 8. Secondly, the slider 24 can be slid into the OFF position through the use of overcurrent tripping. In the event of an overcurrent flowing through the bimetallic element 23, the bimetallic element 23 is heated in such a way that it is deflected. As a result of this deflection of the bimetallic element 23, the locked slider 24 in the ON position is released or unlatched from a latch or snap-fit connection. The slider 24 is slid into its OFF position due to the restoring force of the leaf-spring-like contact springs 14, 15 in a direction of tripping or spring force 29 thereof.

Figure 3:
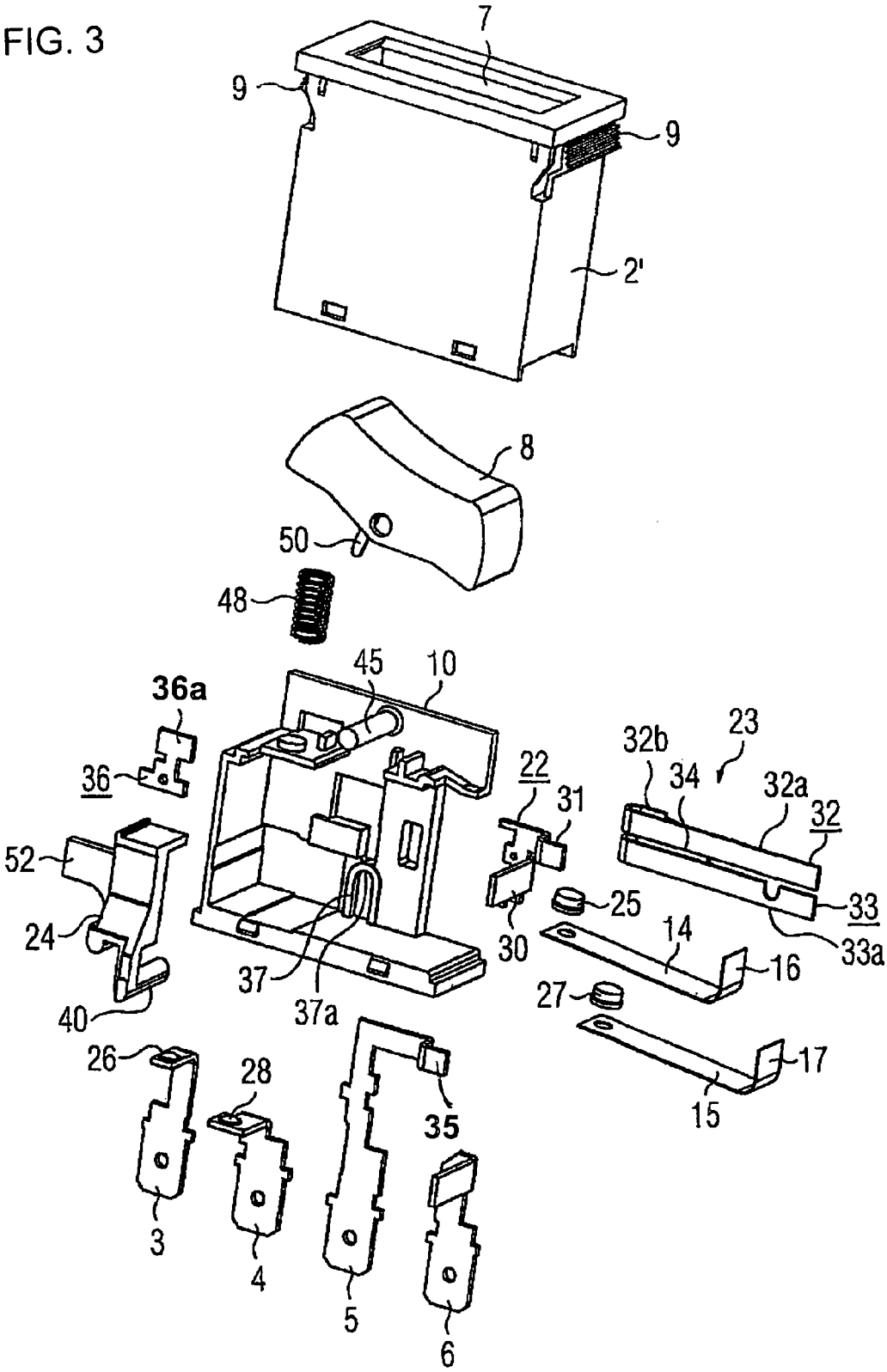
FIG. 3 is an exploded, perspective view of individual components of the protective switch.

FIG. 3 shows the protective switch 1 in an exploded view. In this case, the intermediate piece 22 is shown with a first angled-off holding end 30 for the contact spring 14. The intermediate piece 22 has a further, second holding end 31 for the bimetallic element 23. The second holding end 31 is bent away from the first holding end 30 at approximately right angles.

Figure 4:
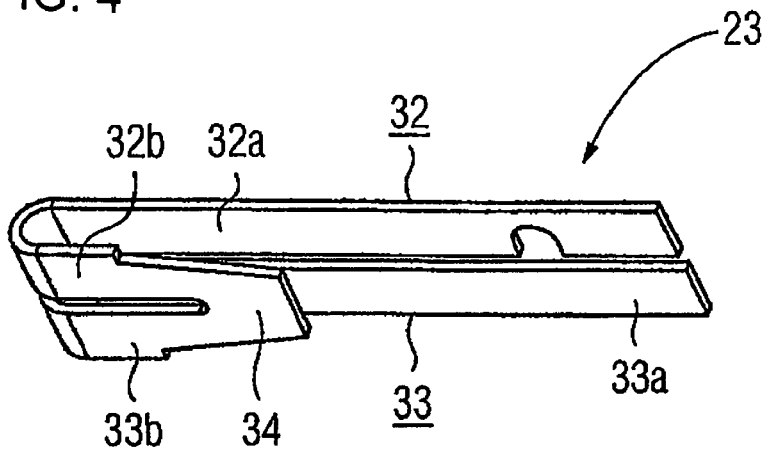
FIG. 4 is a perspective view of a bimetallic element in the protective switch.

As is seen in FIGS. 3 and 4, the bimetallic element 23 is bent in an approximately U shape and, in order to form two comparatively long bimetallic strips 32*a*, 33*a* and two comparatively short bimetallic strips 32*b*, 33*b*, it includes two bimetallic element limbs 32, 33 which run at a distance from one another and which merge and are connected to one another at a bimetallic element end 34. The holding end 31 of the intermediate piece 22 is connected to the bimetallic element limb 33, whereas the bimetallic element limb 32 is connected to an angled-off or offset free end 35 of the contact connection 5.

FIG. 3 also shows an aligning element 36, also referred to below as a support element, which is preferably injection-molded into the plastic housing base 10 in the form of an injection-molded part and is thus attached thereto. A spring tongue 36*a* on the aligning element 36 can be deflected in the direction of the short bimetallic strips 32*b*, 33*b* in order to set or align the bimetallic element 23. The contacts or contact points 25, 27 on the contact springs 14 and 15 and the mating contacts 26, 28 covering them on the contact connections 3 and 4, can be used to complete and interrupt the respective circuit.

Figure 5:
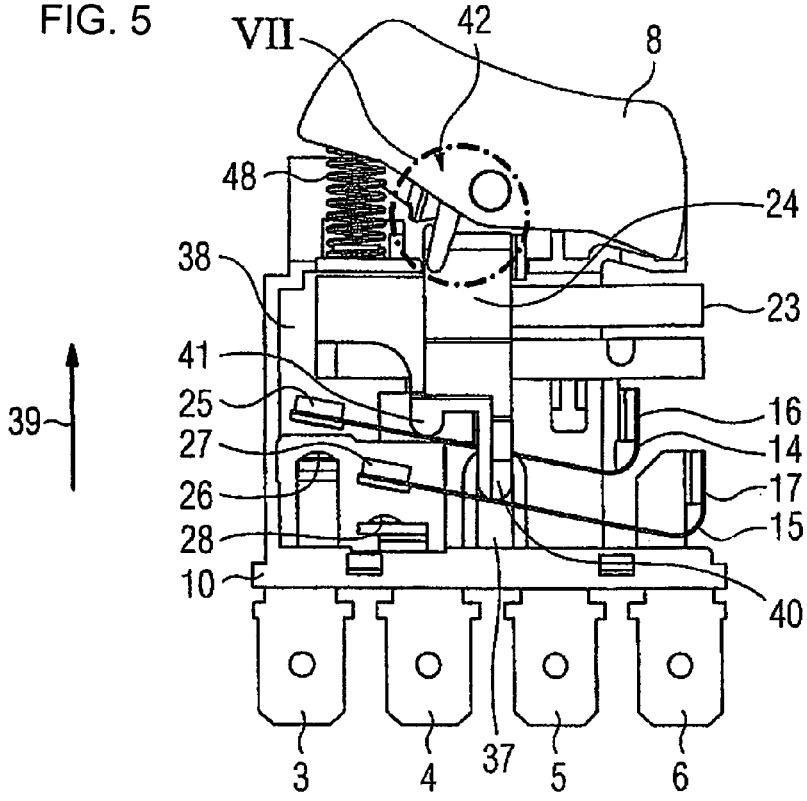
FIGS. 5 and 6 are side-elevational views of the protective switch shown in FIG. 2, with a slider respectively shown in an OFF position and in an ON position.
Figure 6:
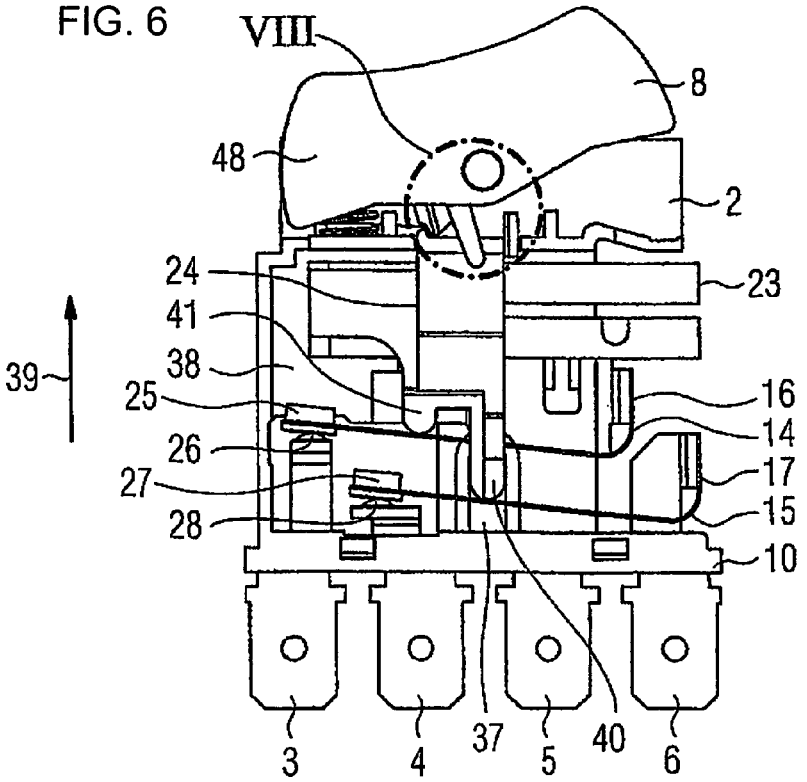

FIGS. 5 and 6 show a side view of the protective switch 1. In this case, the slider 24 is positioned in the OFF position in FIG. 5, whereas the slider 24 has been slid into the ON position in FIG. 6. The housing base 10 has a slider guide 37 with an upper stop 37*a* for the slider 24 (seen in FIG. 3). The slider guide 37 is in the form of a slot-like recess or cutout made in a reverse 38 of the housing base 10 along a sliding direction 39 for the slider 24. This closed recess 37 is limited by the slider stop 37*a* in the direction of tripping 29.

The slider 24 engages in the recess 37 through the use of a slider arm 40, which is integrally formed thereon. The slider arm 40 of the slider 24 can be slid in the recess 37 as far as the stop 37*a* and is additionally used as a pressure lever for acting on the contact spring 15. The slider 24 has a further slider arm 41, which is used as a pressure lever for acting on the contact spring 14 and is integrally formed on the slider 24 in the direction of sliding 39, particularly with a parallel offset relative to the slider arm 40.

In the OFF position of the slider 24, the contacts 25, 26 between the contact spring 14 and the contact connection 3 as well as the contacts 27, 28 between the contact spring 15 and the contact connection 4, are open. In the OFF position of the slider 24 (seen in FIG. 5), a latch or snap-fit connection 42 formed between the operating element 8 and the slider 24 is also unlocked. By contrast, the latch connection 42 is locked in the ON position of the slider 24 shown in FIG. 6.

Figure 7:
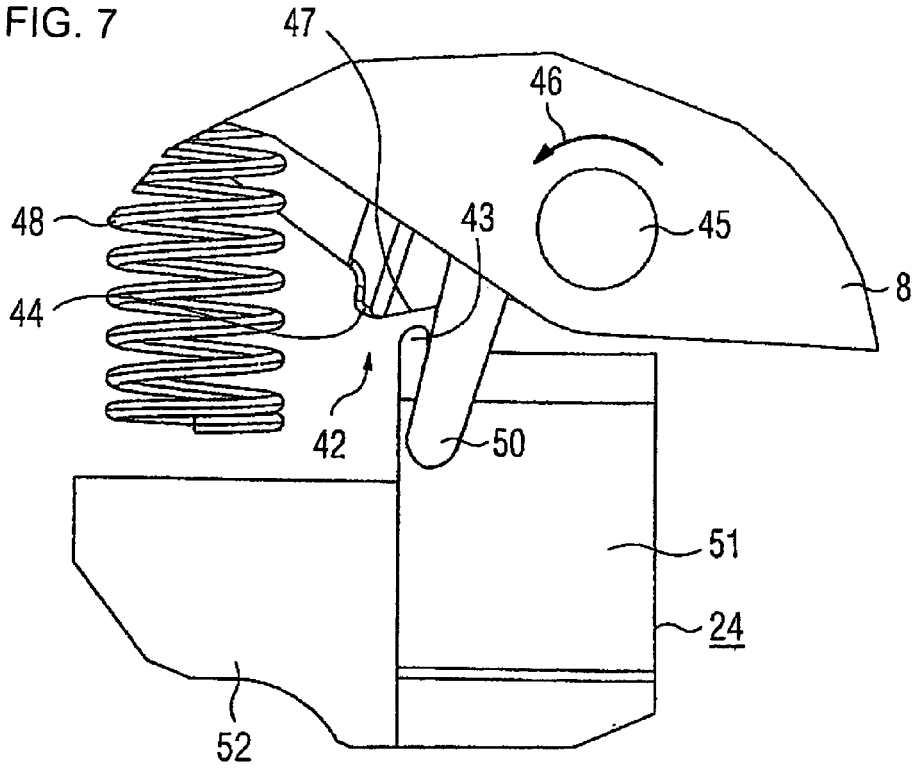
FIGS. 7 and 8 are enlarged, fragmentary, side-elevational views of portions VII and VIII of FIGS. 5 and 6 respectively showing the slider in the OFF position and in the ON position.
Figure 8:
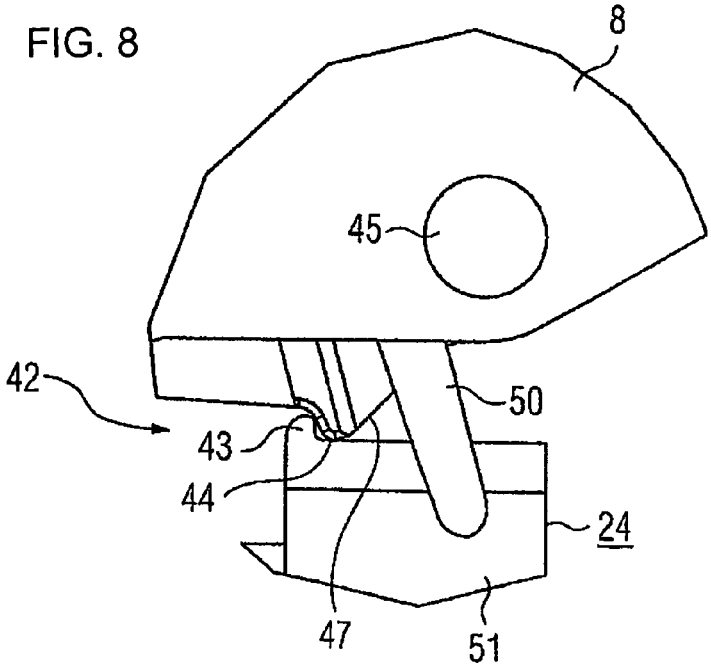

FIGS. 7 and 8 are respective enlarged portions VII and VIII of FIGS. 5 and 6 showing the latch connection 42 for the protective switch 1 in the unlocked and in the locked state of the slider 24 with the operating element 8. The latch connection 42 is formed by a trip cam 43, integrally formed in the slider 24, as a second latch element and by a detent 44, integrally formed on the operating element 8, as a first latch element.

In order to slide the slider 24 from the OFF position shown in FIG. 7 into the ON position shown in FIG. 8, the operating element 8 is disposed so as to pivot or rotate around a journal 45, integrally formed on the housing base 10, in a turn-on direction 46. The operating element 8 has a trip edge 47 integrally formed thereon, directly next to the detent 44. When the operating element 8 is tilted in the turn-on direction 46, the trip cam 43 travels along the trip edge 47 until the trip cam 43 engages behind the detent 44, as is seen in FIG. 8, and thus latches. In FIG. 8, the slider 24 is in the ON position, in which the trip cam 43 is locked by the detent 44 acting as a locking element. The slider 24 is locked in this turned-on position.

Returning the slider 24 from the ON position to the OFF position due to overcurrent tripping is effected by virtue of the deflection of the bimetallic element 23 from the plane of the drawing shown in FIGS. 2, 5 and 6, with the result that the latch connection 42 is automatically unlocked. In order to ensure automatic return of the slider 24 from the ON position to the OFF position as a result of the spring or restoring force of the contact springs 14, 15, the operating element 8 and the housing base 10 additionally have a restoring spring 48 provided between them in the form of a spiral spring, which automatically returns the operating element 8 from the turned-on position to a turned-off position. The overcurrent tripping is visible or recognizable from outside of the housing 2.

Figure 9:
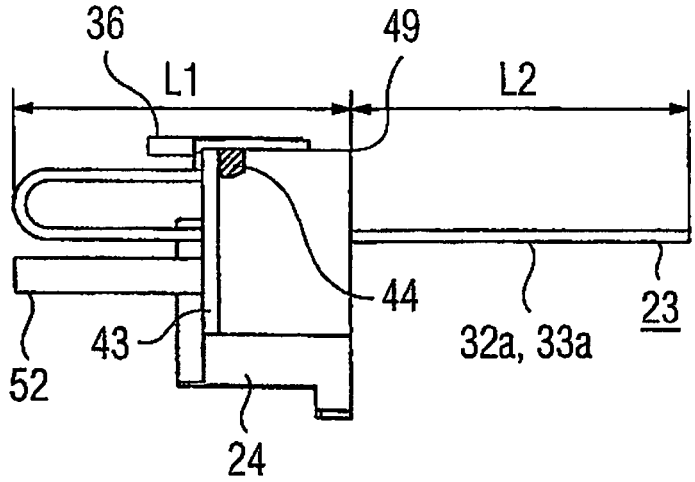
FIGS. 9 and 10 are plan views of the slider in neutral and rotated positions with a locked and an unlocked latch connection as shown in FIG. 6.
Figure 10:
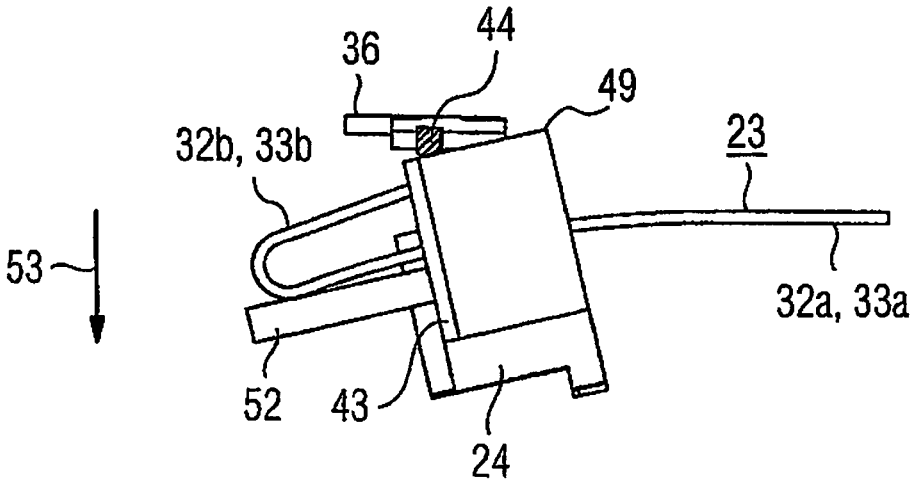

As can be seen in FIGS. 9 and 10, for the purpose of automatically unlocking the latch connection 42 as a result of the overcurrent tripping, the slider 24 is mounted on the housing base 10 so as to be able to rotate around an axis of rotation or slider longitudinal axis or direction 49. In this case, FIG. 9 shows the bimetallic element 23 and the slider 24 in a neutral position with the latch connection 42 locked, whereas FIG. 10 shows the slider 24 in a rotated position and the bimetallic element 23 in a deflected state with the latch connection 42 unlocked. The operating element 8 has a spring tab 50 provided thereon or formed in one-piece therewith, in order to rotate the slider 24 back after the latch connection 42 has been unlocked. While the operating element 8 is returning to its turned-off position, the spring tab 50 travels along a front 51 of the slider 24, in contact therewith, in such a way that the slider 24 rotated anticlockwise as a result of the unlocking of the latch connection 42, is rotated back into its neutral position.

An unlatching element 52 in the form of a wing is integrally formed on or in one-piece with the slider 24 in order to extend a rotary lever for rotating the slider 24 to bring about reliable unlocking of the latch connection 42 through rotation of the slider 24. The bimetallic element 23 is preferably disposed in the housing base 10 so as to run transversely with respect to the axis of rotation or longitudinal axis or direction 49 of the slider 24. In this case, the bimetallic element 23 has first and second longitudinal sections L1 and L2. The first longitudinal section L1 of the bimetallic element 23 covers the slider 24 and its wing 52 in order to unlatch the latched or locked slider 24.

In the event of overcurrent tripping, the short bimetallic strips 32*b*, 33*b* of the bimetallic element 23 held on the long bimetallic strips 32*a*, 33*a* are deflected counter to a direction of deflection 53 of the bimetallic element. In this case, the short bimetallic strips 32*b*, 33*b* bear against the aligning element 36, so that as a result of their support on the aligning element 36, an additional force component is produced in the direction of deflection 53 of the bimetallic element 23. The long bimetallic strips 32*a*, 33*a* of the bimetallic element, which are likewise deflected in the direction of deflection 53, are thus supported by the short bimetallic strips 32*b*, 33*b* by virtue of them being supported on the aligning element 36 in the opposite direction.

The bimetallic element 24 is disposed in the housing base 10 in such a way that the short bimetallic strips 32*b*, 33*b* face away from the slider 24, whereas the long bimetallic strips 32*a*, 33*a* face toward the slider 24 and its wing 52. When the bimetallic element 24 is deflected, the slider wing 52 is acted upon by the first longitudinal section L1, covering the slider 24 and its wing 52, and thus by the short bimetallic strips 32*b*, 33*b* and partly by the long bimetallic strips 32*a*, 33*a*.

In order to increase the tripping force of the bimetallic element 24 to unlock the latch connection 42 reliably in the event of overcurrent tripping, the aligning element 36 integrally formed in the housing base 10 is positioned on a side of the bimetallic element 23 which faces away from the slider wing 52. The configuration of the aligning element 36 is comparatively clear to see in FIG. 11.

Figure 11:
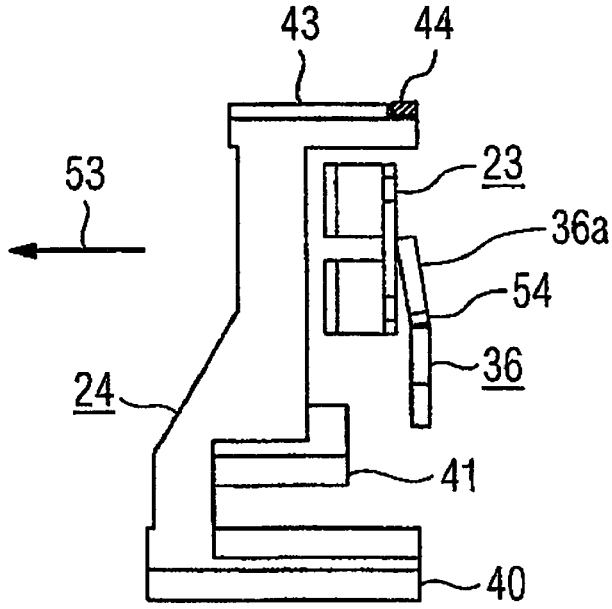
FIG. 11 is a side-elevational view of the slider in the neutral position with a locked latch connection as shown in FIG. 9.

FIG. 11 shows the slider 24 and the bimetallic element 23 in a side view. The spring tongue 36*a* can be bent in and counter to the direction of deflection 53 of the bimetallic element 24 through a bending location 54 on the aligning element 36. The aligning element 36 with its spring tongue 36*a* is used to orient or align the bimetallic element 24 to cover the wing 52 of the slider 24 in such a way that the deflection of the bimetallic element 24 brings about rotation of the slider 24 and therefore reliable unlocking of the latch connection 42. In order to align the bimetallic element 24, the spring tongue 36*a* is deflected to a greater or lesser extent around the bending location or bending edge 54 (which is produced by a local material weakness in the aligning element 36), in the direction of the short bimetallic strips 32*b*, 33*b* of the bimetallic element 24 and therefore in the direction of deflection 53.

I claim:

1. A protective switch for protecting a circuit, the protective switch comprising:

a housing;

at least first and second contact connections projecting from said housing;

an operating element;

a contact spring electrically conductively connected to said first contact connection and having a free end covering said second contact connection for making contact, said contact spring having a restoring force;

a slider guided for sliding in said housing, said slider having a contact end bearing against and acting upon said contact spring counter to said restoring force in a contact position, said slider having a longitudinal direction, and said slider being latched by said operating element in a turned-on position; and a bimetallic element disposed in said housing and extended transversely relative to said longitudinal direction of said slider, said bimetallic element being electrically connected between said first contact connection and through said contact spring to said second contact connection, said bimetallic element being coupled to said slider for thermal tripping and having first and second longitudinal sections, said first longitudinal section at least partly covering and unlatching said slider as a result of an overcurrent to break contact.

2. The protective switch according to claim 1, wherein said operating element is a rocker switch.

3. The protective switch according to claim 1, wherein said operating element has a first latch element and said slider has a second latch element, forming a latch connection for said slider in said turned-on position.

4. The protective switch according to claim 3, wherein said latch elements slide into a latch position through a trip edge when said operating element is operated in a turn-on direction.

5. The protective switch according to claim 1, which further comprises a slider guide in said housing, said contact end of said slider being guided in said slider guide.

6. The protective switch according to claim 1, wherein said slider is rotatable in said housing around said longitudinal direction of said slider from a starting position, for unlatching said latched slider.

7. The protective switch according to claim 6, which further comprises a spring tongue returning said rotated slider to said starting position.

8. The protective switch according to claim 7, wherein said spring tongue is formed in one piece with said operating element.

9. The protective switch according to claim 1, which further comprises another contact spring, said contact springs being disposed above one another in said longitudinal direction of said slider, and said contact end of said slider having two contact arms disposed in different planes in said longitudinal direction of said slider, each of said contact arms bearing against a respective one of said contact springs.

10. The protective switch according to claim 1, wherein said bimetallic element has first and second bimetallic element limbs extended at a distance from each other and a bimetallic element end at which said bimetallic element limbs merge.

11. The protective switch according to claim 1, wherein said bimetallic element is bent in a U shape to form a first, comparatively short bimetallic strip and a second, comparatively long bimetallic strip.

12. The protective switch according to claim 11, wherein said second, long bimetallic strip is electrically conductively connected to said first contact connection.

13. The protective switch according to claim 10, wherein said first bimetallic element limb is electrically conductively connected to said first contact connection, and said second bimetallic element limb is electrically conductively connected to said contact spring.

14. The protective switch according to claim 13, which further comprises an intermediate piece connecting said second bimetallic element limb to said contact spring.

15. The protective switch according to claim 1, which further comprises an unlatching element formed in one piece with said slider and extended along said first longitudinal section of said bimetallic element.

16. The protective switch according to claim 1, which further comprises an aligning element disposed in said housing and having a bending location for aligning said bimetallic element.

17. The protective switch according to claim 11, which further comprises an aligning element disposed in said housing and having a bending location for aligning said bimetallic element, said first, short bimetallic strip bearing against said aligning element.

18. The protective switch according to claim 1, which further comprises a slider guide having a slider stop for guiding said slider in said housing.

19. The protective switch according to claim 1, which further comprises a restoring spring having a restoring force, said operating element being pivotable between a turned-on position and a turned-off position and latching counter to said restoring force of said restoring spring in a turn-on direction.

20. The protective switch according to claim 1, wherein said housing has a housing base and a housing cap to be fitted onto said housing base, said housing cap having a leadthrough opening for said operating element and at least one latch arm integrally formed on said housing cap in vicinity of said leadthrough opening for mounting said housing in an installation opening.

* * * * *

UNITED STATES PATENT AND TRADEMARK OFFICE

CERTIFICATE OF CORRECTION

PATENT NO. : 7,312,687 B2
APPLICATION NO. : 11/725219
DATED : December 25, 2007
INVENTOR(S) : Wolfgang Ullermann It is certified that error appears in the above-identified patent and that said Letters Patent is hereby corrected as shown below:

On the Title Page

Item (73) should read:

Item (73) Assignee: Ellenberger & Poensgen GmbH, Altdorf (DE)

Signed and Sealed this

Thirteenth Day of May, 2008

JON W. DUDAS
*Director of the United States Patent and Trademark Office*